US011032881B2

(12) United States Patent
Hu et al.

(10) Patent No.: US 11,032,881 B2
(45) Date of Patent: Jun. 8, 2021

(54) CONTROLLER FOR CONTROLLING LIGHT SOURCE MODULE

(71) Applicant: O2Micro, Inc., Santa Clara, CA (US)

(72) Inventors: Rong Hu, Beijing (CN); Yung-Lin Lin, Palo Alto, CA (US); Hiroshi Yamazaki, Tokyo (JP); Naoyuki Fujita, Tokyo (JP)

(73) Assignee: O2Micro Inc., Santa Clara, CA (US)

( * ) Notice: Subject to any disclaimer, the term of this patent is extended or adjusted under 35 U.S.C. 154(b) by 55 days.

(21) Appl. No.: 16/518,316

(22) Filed: Jul. 22, 2019

(65) Prior Publication Data

US 2021/0029788 A1 Jan. 28, 2021

(51) Int. Cl.
*H05B 45/10* (2020.01)
*H05B 39/04* (2006.01)
*H05B 45/37* (2020.01)

(52) U.S. Cl.
CPC ..... *H05B 45/10* (2020.01); *H05B 39/047* (2013.01); *H05B 45/37* (2020.01)

(58) Field of Classification Search
None
See application file for complete search history.

(56) References Cited

U.S. PATENT DOCUMENTS 5,741,183 A * 4/1998 Acres ..... G07F 17/32 463/16
6,118,186 A * 9/2000 Scott ..... H02P 9/04 290/1 A
6,166,496 A * 12/2000 Lys ..... H05B 47/18 315/316
6,459,919 B1 * 10/2002 Lys ..... G09G 3/2014 600/407
8,278,830 B2 * 10/2012 Archibald ..... H05B 45/46 315/209 R
8,334,662 B2 * 12/2012 Jin ..... H01L 22/14 315/299
8,368,636 B2 * 2/2013 Shteynberg ..... H05B 45/37 345/102
8,410,716 B2 * 4/2013 Yao ..... H05B 45/46 315/291
8,704,456 B2 * 4/2014 Shteynberg ..... H05B 45/10 315/291
8,716,947 B2 * 5/2014 Elder ..... H05B 45/37 315/224

(Continued)

*Primary Examiner* — Amy Cohen Johnson
*Assistant Examiner* — Srinivas Sathiraju

(57) ABSTRACT

A controller for controlling a light source module including a first LED array and a second LED array includes a power input terminal, a first power output terminal and a second power output terminal. The power input terminal is operable for receiving electric power from a power converter. The first power terminal is coupled to the first LED array, and the second power output terminal is coupled to the second LED array. The controller is operable for delivering the electric power to the first LED array via the first power output terminal in a first sequence of discrete time slots, and for delivering the electric power to the second LED array via the second power output terminal in a second sequence of discrete time slots. The first sequence of discrete time slots and the second sequence of discrete time slots are mutually exclusive.

11 Claims, 3 Drawing Sheets

(56) References Cited

U.S. PATENT DOCUMENTS 8,749,177 B2 * 6/2014 Shteynberg ..... H05B 45/24 315/316
9,041,305 B2 * 5/2015 Shteynberg ..... H05B 45/10 315/247
9,370,066 B2 * 6/2016 Han ..... H05B 45/395
9,433,047 B2 * 8/2016 Huynh ..... H05B 45/46
9,451,664 B2 * 9/2016 Jin ..... H05B 45/46
9,468,064 B1 * 10/2016 Wu ..... H05B 45/46
9,478,175 B2 * 10/2016 Lim ..... G02F 1/133603
9,531,931 B2 * 12/2016 Patel ..... H04N 5/2256
9,788,376 B2 * 10/2017 Mio ..... H05B 45/46
9,835,668 B2 * 12/2017 Kriebernegg ..... G01R 31/50
9,860,946 B2 * 1/2018 LoCascio ..... H05B 45/44
10,278,251 B1 * 4/2019 Fledderman ..... H05B 47/185
10,594,916 B2 * 3/2020 Sivan ..... G06F 3/013
10,721,804 B2 * 7/2020 Chan ..... H05B 45/347
10,732,714 B2 * 8/2020 Rao ..... G06F 3/01
10,734,897 B2 * 8/2020 Petersen ..... H02M 3/156
2003/0100837 A1 * 5/2003 Lys ..... F21S 4/28 600/476
2010/0311488 A1 * 12/2010 Miller ..... G07F 17/3232 463/16
2010/0311494 A1 * 12/2010 Miller ..... G07F 17/3223 463/22
2010/0312625 A1 * 12/2010 Miller ..... A63F 1/02 705/14.5
2013/0249429 A1 * 9/2013 Woytowitz ..... H05B 47/185 315/246
2015/0068069 A1 * 3/2015 Tran ..... A43B 13/183 36/136
2015/0237700 A1 * 8/2015 Woytowitz ..... H05B 47/19 315/307
2018/0321748 A1 * 11/2018 Rao ..... G06F 3/0416
2019/0041008 A1 * 2/2019 Xiong ..... F21K 9/275
2019/0058242 A1 * 2/2019 Tabe ..... H01Q 1/248
2019/0154439 A1 * 5/2019 Binder ..... G01S 15/08
2019/0182415 A1 * 6/2019 Sivan ..... G06F 3/013
2019/0313503 A1 * 10/2019 Woytowitz ..... H05B 47/185
2020/0195833 A1 * 6/2020 Sivan ..... G06F 3/013
2020/0253023 A1 * 8/2020 Bedell ..... H05B 47/16
2020/0256521 A1 * 8/2020 Xiong ..... F21K 9/278

* cited by examiner

CONTROLLER FOR CONTROLLING LIGHT SOURCE MODULE

BACKGROUND

In a Light-Emitting Diode (LED) display system such as a Liquid Crystal Display (LCD) TV, a controller is used to control the power of multiple LED strings for back-lighting. Because the controller has a given number of control pins, only a limited number of LED strings can be controlled by one controller. In order to control more LED strings, more controllers are needed, which increases the cost of the system.

SUMMARY

In embodiments, a controller for controlling a light source module including a first LED array and a second LED array includes a power input terminal, a first power output terminal and a second power output terminal. The power input terminal is operable for receiving electric power from a power converter. The first power output terminal is coupled to the first LED array, and the second power output terminal is coupled to the second LED array. The controller is operable for delivering the electric power to the first LED array via the first power output terminal in a first sequence of discrete time slots, and for delivering the electric power to the second LED array via the second power output terminal in a second sequence of discrete time slots. The first sequence of discrete time slots and the second sequence of discrete time slots are mutually exclusive.

In other embodiments, a controller is coupled to a power source and operable for controlling a light source module including a first LED array and a second LED array. Each of the first LED array and the second LED array includes multiple LED strings. The controller includes a switching module and a current regulation module. The switching module is coupled to the first LED array and the second LED array and is operable for alternately delivering power to the first LED array and to the second LED array. In other words, power is delivered to the first LED array (but not to another LED array), and then power is delivered to the second LED array (but not to another LED array), and so on depending on the number of LED arrays, and then the pattern/cycle is repeated. The current regulation module is coupled to the first LED array and the second LED array and is operable for linearly regulating a current of each LED string in the first LED array and a current of each LED string in the second LED array.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in combination with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
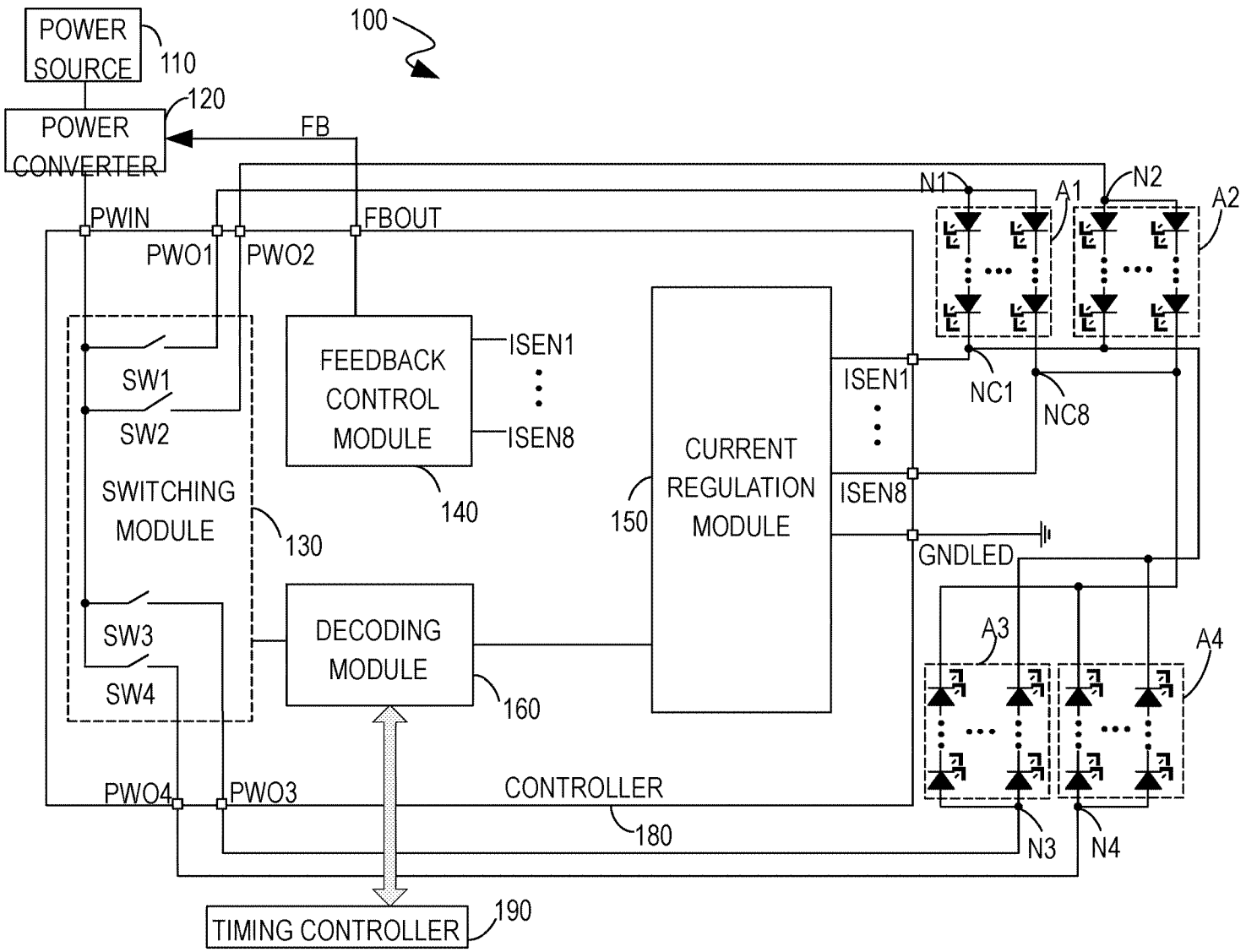
FIG. 1 shows a light source driving circuit including a controller for controlling a light source module, in accordance with embodiments of the present invention.

FIG. 1 shows a light source driving circuit 100 including a controller 180 for controlling a light source module, in accordance with embodiments of the present invention. In the example of FIG. 1, the light source module includes four LED arrays A1, A2, A3 and A4, where each LED array includes multiple (e.g., eight) LED strings. This example is used as the basis for the discussion below; however, the invention is not limited to four LED arrays and/or eight LED strings per array.

The controller 180 receives electric power from a power converter 120. The power converter 120 is coupled between the controller 180 and a power source 110. The controller 180 includes a power input terminal PWIN, a feedback terminal FBOUT, multiple power output terminals PWO1-PWO4 and multiple current sensing terminals ISEN1-ISEN8. The number of the power output terminals is equal to the number of the LED arrays. The number of the current sensing terminals is equal to the number of the LED strings in each LED array. The controller 180 includes a switching module 130, a feedback control module 140, a current regulation module 150 and a decoding module 160.

The power input terminal PWIN is coupled to the power source 110 through the power converter 120 and is operable for receiving electric power from the power converter 120. The power output terminals PWO1-PWO4 are coupled to the LED arrays A1-A4, respectively. The controller 180 is operable for delivering the electric power to the LED arrays A1-A4 via the power output terminals PWO1-PWO4 in a first sequence, a second sequence, a third sequence, and a fourth sequence of discrete time slots, respectively. The first, second, third and fourth sequences of discrete time slots are mutually exclusive; that is, they do not overlap in time.

Figure 3:
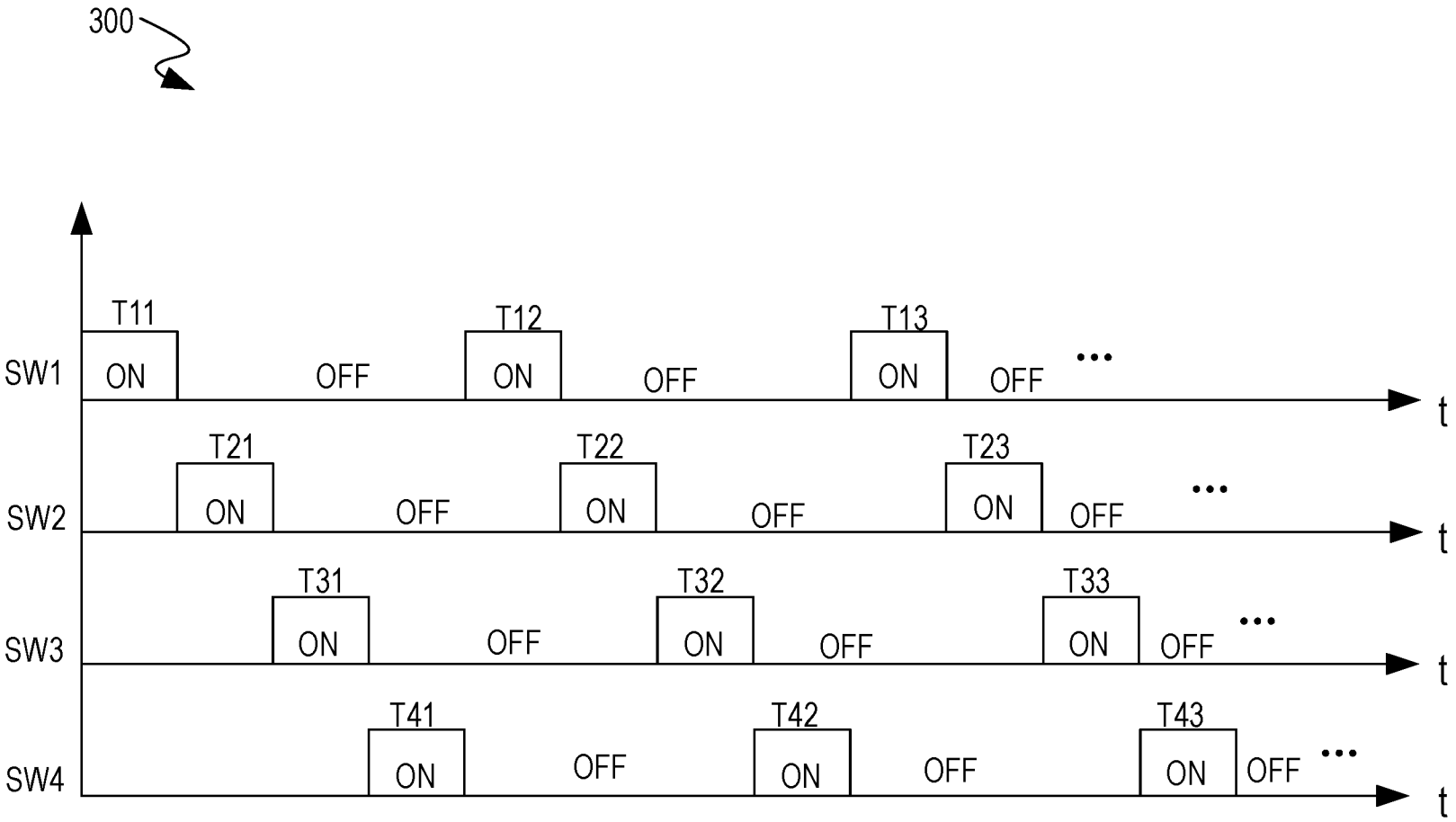
FIG. 3 shows a timing diagram of a controller for controlling a light source module, in accordance with embodiments of the present invention.

More specifically, the switching module 130 includes multiple switches SW1-SW4 that are coupled between the power input terminal PWIN and a corresponding power output terminal. For example, a first switch SW1 is coupled between the power input terminal PWIN and the first power output terminal PWO1, and a second switch SW2 is coupled between the power input terminal PWIN and the second power output terminal PWO2. Referring to FIG. 3, the controller 180 is operable for turning on the first switch SW1 in the first sequence of discrete time slots T11, T12, T13, turning on the second switch SW2 in the second sequence of discrete time slots T21, T22, T23, turning on the third switch SW3 in the third sequence of discrete time slots T31, T32, T33, and turning on the fourth switch SW4 in the fourth sequence of discrete time slots T41, T42, T43. The first, second, third and fourth sequences of discrete time slots are mutually exclusive and are interleaved as shown in the example of FIG. 3.

With reference back to FIG. 1, the current sensing terminals ISEN1-ISEN8 are coupled to the LED arrays A1-A4 for sensing a level of a current of each LED string in the LED arrays A1-A4 in the manner described below. The current regulation module 150 is coupled to the LED arrays A1-A4 via the sensing terminals ISEN1-ISEN8 and is operable for linearly regulating the current of each LED string in the LED arrays A1-A4, as described further below in the discussion of FIG. 2.

Continuing with reference to FIG. 1, the feedback control module 140 is operable for generating a feedback signal FB based on a power requirement of the light source module to control the power converter 120, such that the electric power from the power converter can satisfy the power requirement of the light source module. The feedback signal FB is provided to the power converter 120 via the feedback terminal FBOUT. The feedback control module 140 is coupled to the current sensing terminals ISEN1-ISEN8 and generates the feedback signal FB based on the voltages at the current sensing terminals ISEN1-ISEN8. The voltages at the current sensing terminals ISEN1-ISEN8 can indicate a power requirement of the light source module. More specifically, the feedback control module 140 selects a minimum voltage among the voltages at the current sensing terminals ISEN1-ISEN8 and compares the minimum voltage with a predetermined voltage range to generate the feedback signal FB. The power converter 120, under control of the feedback signal FB, increases or decreases the electric power such that the minimum voltage is within the predetermined voltage range.

The decoding module 160 is operable for receiving a timing signal from a timing controller 190 (e.g., a Micro Controlling Unit) and for generating a switching signal to control the switches SW1-SW4 in the switching module 130 based on the timing signal. The decoding module 160 is further operable for generating multiple control signals to control the current regulation module 150. Accordingly, multiple current regulation units (shown in FIG. 2) can be independently enabled and disabled by a corresponding control signal. The decoding module 160 can communicate with the timing controller through, for example, a Serial Peripheral Interface (SPI).

The LED arrays A1-A4 are configured to receive electric power from power output terminals PWO1-PWO4, respectively, and share the current sensing terminals ISEN1-ISEN8. More specifically, the anodes of the LED strings in the first LED array A1 are connected to a common node N1, and the common node N1 is connected to the first power output terminal PWO1. The anodes of the LED strings in the second LED array A2 are connected to a common node N2, and the common node N2 is connected to the second power output terminal PWO2. The anodes of the LED strings in the third LED array A3 are connected to a common node N3, and the common node N3 is connected to the third power output terminal PWO3. The anodes of the LED strings in the fourth LED array A4 are connected to a common node N4, and the common node N4 is connected to the fourth power output terminal PWO4.

On the other hand, the cathode of a first LED string in the first LED array A1, the cathode of a first LED string in the second LED array A2, the cathode of a first LED string in the third LED array A3 and the cathode of a first LED string in the fourth LED array A4 are connected to a first common node NC1. The common node NC1 is connected to a current sensing terminal ISEN1. Thus, the current sensing terminal ISEN1 senses the current on each of the first LED strings in each of the LED arrays. Similarly, the cathodes of each of the second LED strings in each LED array are connected to a second common node NC2 (not shown), which is connected to a current sensing terminal ISEN2 (not shown), and so on. The cathodes of each of the last (e.g., eighth) LED strings in each LED array are connected to the respective (e.g., eighth) common node NC8, which is connected to a current sensing terminal ISEN8.

In operation, if the switch SW1 is turned on, then a current flows through the first power output terminal PWO1, the common node N1 to the first LED array A1, and then back to the controller 180 through the common nodes NC1-NC8 and the current sensing terminals ISEN1-ISEN8. If the switch SW2 is turned on, then a current flows through the second power output terminal PWO2, the common node N2 to the second LED array A2, and then back to the controller 180 through the common nodes NC1-NC8 and the current sensing terminals ISEN1-ISEN8. As such, the configuration of the controller 180 and the structure of the circuit 100 allow the LED arrays A1-A4 to share the same group of current sensing terminals SEN1-ISEN8.

Figure 2:
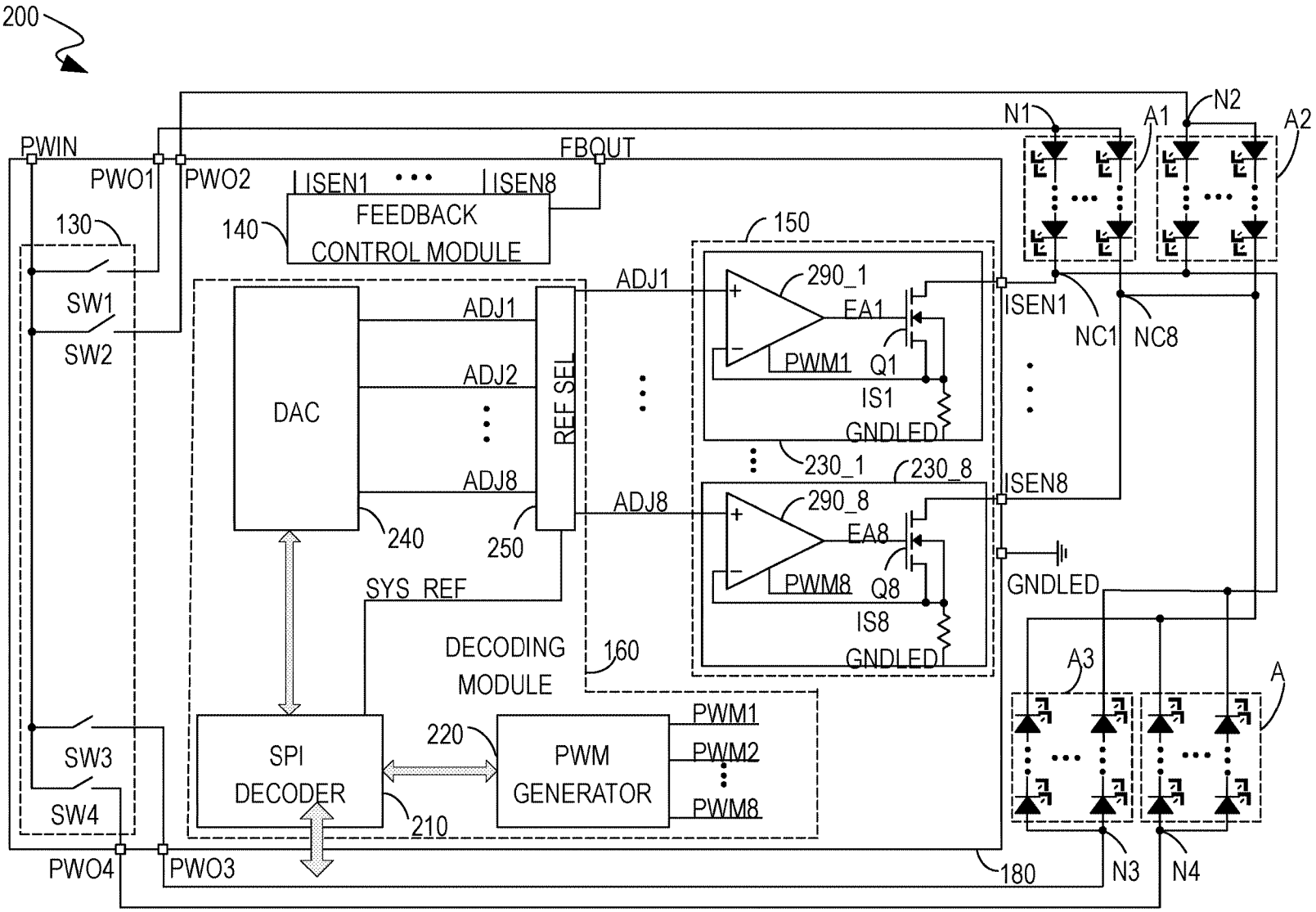
FIG. 2 shows a light source driving circuit including a controller for controlling a light source module, in accordance with embodiments of the present invention.

FIG. 2 shows a light source driving circuit 200 including a controller 180 for controlling a light source module, in accordance with embodiments of the present invention. FIG. 2 shows a detailed view of the internal structure of the controller 180. The controller 180 includes a switching module 130, a feedback control module 140, a current regulation module 150 and a decoding module 160.

The current regulation module 150 includes multiple current regulation units 230_1-230_8 coupled to the current sensing terminals ISEN1-ISEN8, respectively. The current regulation units 230_1-230_8 are operable for linearly regulating current of each LED string in the LED arrays A1-A4, and each current regulation unit is independently and individually enabled and disabled by a corresponding control signal of control signals PWM1-PWM8. The control signals PWM1-PWM8 can be Pulse Width Modulation (PWM) signals.

More specifically, each current regulation unit 230_1-230_8 includes a respective amplifier 290_1-290_8 coupled to a respective switch Q1-Q8. Each switch Q1-Q8 is in coupled in series with a corresponding LED string. Each current regulation unit has a similar configuration. Take current regulation unit 230_1 as an example. A non-inverting input of the amplifier 290_1 receives a reference signal ADJ1 indicative of a target current. An inverting input of the amplifier 290_1 receives a sensing signal IS1 indicative of a level of a current through the corresponding LED string. The amplifier 290_1 compares the reference signal ADJ1 with the sensing signal IS1 to generate an error signal EA1, and linearly controls the switch Q1 with the error signal EA1 so as to regulate the current of the corresponding LED string so that current is at the target current. The switch Q1 is controlled linearly means that, instead of either being fully turned on or fully turned off, the switch Q1 can be partially turned on such that a level of the current flowing through the switch Q1 can be continuously (non-discretely) and gradually adjusted.

The amplifier 290_1 is controlled by a control signal PWM1. If the control signal PWM1 is in a first state (e.g., logic high), then the amplifier 290_1 is enabled and the corresponding LED string is turned on and regulated as described above. If the control signal PWM1 is in a second state (e.g., logic low), then the amplifier 290_1 is disabled and the corresponding LED string is turned off.

In an embodiment, the decoding module 160 includes a SPI decoder 210, a PWM generator 220, a digital-analog convertor (DAC) 240, and a reference selection unit 250. The SPI decoder 210 receives a timing signal from a timing controller (not shown) and decodes the timing signal. The PWM generator 220 is coupled to the SPI decoder 210 and generates the control signals PWM1-PWM8 based on the timing signal. The DAC 240 is coupled to the SPI decoder and generates reference signals ADJ1-ADJ8. The reference selection unit 250 selects either the reference signals ADJ1-ADJ8 or a system reference signal SYS_REF that is also generated from the SPI decoder 210, and supplies the selected signal(s) (e.g., ADJ1-ADJ8 or SYS_REF) to the respective amplifier 290_1-290_8. That is, either the non-inverting input of the amplifier 290_1 receives the signal ADJ1, the non-inverting input of the amplifier 290_2 receives the signal ADJ2, and so on, or the non-inverting inputs of the amplifiers 290_1-290_8 all receive the signal SYS_REF. Furthermore, the decoding module 160 processes the timing signal and provides a switching signal to the switching module 130. The switching module 130 controls the switches SW1-SW4 with the switching signal to turn on the switches SW1-SW4 in four sequences of discrete time slots that are mutually exclusive.

As described above, the present invention includes a controller for controlling a light source module. The controller is operable for alternately delivering electric power to multiple LED arrays, and for regulating the current of each LED string in the LED arrays. The controller enables the LED arrays to share a same group of current sensing terminals of the controller. Advantageously, multiple LED arrays can be controlled by a single controller, and thus the cost of the system is reduced. Moreover, each LED string in the LED arrays can be independently and individually regulated or disabled, which allows flexible and fine (accurate or precise) levels of dimming in a display system.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A controller operable for controlling a light source module comprising a first Light-Emitting Diode (LED) array and a second LED array, wherein said first LED array comprises a first plurality of LED strings and said second LED array comprises a second plurality of LED strings, said controller comprising:

a power input terminal, operable for receiving electric power from a power converter;

a first power output terminal, coupled to said first LED array, a second power output terminal, coupled to said second LED array, a plurality of current sensing terminals, coupled to said first LED array and to said second LED array, operable for sensing a current of each LED string in said first LED array and for sensing a current of each LED string in said second LED array, wherein anodes of said first plurality of LED strings are connected to a first common node, wherein said first common node is connected to said first power output terminal, wherein anodes of said second plurality of LED strings are connected to a second common node, wherein said second common node is connected to said second power output terminal, wherein a cathode of a first LED string in said first LED array and a cathode of a first LED string in said second LED array are connected to a third common node, wherein said third common node is connected to a first current sensing terminal of said current sensing terminals, wherein said controller is operable for delivering said electric power to said first LED array via said first power output terminal in a first sequence of discrete time slots, and for delivering said electric power to said second LED array via said second power output terminal in a second sequence of discrete time slots, wherein said first sequence of discrete time slots and said second sequence of discrete time slots are mutually exclusive.

2. The controller of claim 1, further comprising:

a plurality of current regulation units, coupled to said plurality of current sensing terminals and controlled by a plurality of control signals, operable for linearly regulating a current of each LED string in said first LED array and a current of each LED string in said second LED array, wherein each current regulation unit of said current regulation units is independently and individually enabled and disabled by a corresponding control signal of said control signals, wherein each current regulation unit of said current regulation units comprises an amplifier, coupled to a switch that is in series with a respective LED string of said first LED array and a respective LED string of said second LED array, and is operable for controlling said switch linearly by comparing a sensing signal indicative of a current through said respective LED string of said first LED array and said respective LED string of said second LED array with a reference signal indicative of a target current; and wherein said plurality of control signals are PWM signals, wherein said respective LED string of said first LED array and said respective LED string of said second LED array are powered on when a control signal of said control signals, corresponding to said respective LED string of said first LED array and said respective LED string of said second LED array, is in a first state, and wherein said respective LED string of said first LED array and said respective LED string of said second LED array are powered off when said control signal is in a second state.

3. The controller of claim 2, further comprising:

a decoding module operable for receiving a timing signal from a timing controller and for generating said control signals based on said timing signal.

4. The controller of claim 1, further comprising:

a feedback terminal operable for outputting a feedback signal to said power converter to adjust said electric power from said power converter based on a power requirement of said light source module; and a feedback control module, coupled to said feedback terminal, and operable for generating said feedback signal based on voltages at said current sensing terminals.

5. The controller of claim 1, further comprising:

a first switch coupled between said power input terminal and said first power output terminal; and a second switch coupled between said power input terminal and said second power output terminal, wherein said controller is operable for turning on said first switch in said first sequence of discrete time slots, and for turning on said second switch in said second sequence of discrete time slots.

6. The controller of claim 5, further comprising:

a decoding module operable for receiving a timing signal from a timing controller and for generating a switching signal to control said first switch and said second switch based on said timing signal.

7. A controller, coupled to a power source, operable for controlling a light source module comprising a first Light-Emitting Diode (LED) array and a second LED array, wherein said first LED array comprises a first plurality of LED strings and said second LED array comprises a second plurality of LED strings, said controller comprising:

a switching module, coupled to said first LED array and said second LED array, operable for alternately delivering electric power to said first LED array and to said second LED array; and a current regulation module, coupled to said first LED array and to said second LED array, operable for linearly regulating a current of each LED string in said first LED array and a current of each LED string in said second LED array, wherein said switching module comprises:

a first switch, coupled between said power source and said first LED array; and a second switch, coupled between said power source and said second LED array;

wherein said controller is operable for turning on said first switch in a first sequence of discrete time slots, and for turning on said second switch in a second sequence of discrete time slots, wherein said first sequence of discrete time slots and said second sequence of discrete time slots are mutually exclusive;

wherein anodes of said first plurality of LED strings are connected to a first common node, wherein said first common node is connected to a first power output terminal of said controller, wherein said first power output terminal is coupled to said first LED array;

wherein anodes of said second plurality of LED strings are connected to a second common node, wherein said second common node is connected to a second power output terminal of said controller, wherein said second power output terminal is coupled to said second LED array; and wherein a cathode of a first LED string in said first LED array and a cathode of a first LED string in said second LED array are connected to a third common node, wherein said third common node is connected to a first current sensing terminal of a plurality of current sensing terminals of said controller, and wherein said current sensing terminals are coupled to said first LED array and said second LED array and are operable for sensing a current of each LED string in said first LED array and a current of each LED string in said second LED array.

8. The controller of claim 7, further comprising:

a decoding module operable for receiving a timing signal from a timing controller and for generating a switching signal to control said first switch and said second switch based on said timing signal.

9. The controller of claim 7, wherein said current regulation module comprises:

a plurality of current regulation units operable for linearly regulating said current of each LED string in said first LED array and said current of each LED string in said second LED array, wherein each current regulation unit of said current regulation units is independently and individually enabled and disabled by a corresponding control signal of a plurality of control signals;

wherein said current regulation units comprise a first current regulation unit comprising an amplifier and a switch, wherein said switch is in series with said first LED string of said first LED array and said first LED string of said second LED array, and wherein said first current regulation unit is operable for controlling said switch linearly by comparing a sensing signal indicative of a current through said first LED string of said first LED array and said first LED string of said second LED array with a reference signal indicative of a target current; and wherein said plurality of control signals are PWM signals, wherein said first LED string of said first LED array and said first LED string of said second LED array are powered on when a control signal of said control signals is in a first state, and wherein said first LED string of said first LED array and said first LED string of said second LED array are powered off when said control signal is in a second state.

10. The controller of claim 9, further comprising:

a decoding module operable for receiving a timing signal from a timing controller and for generating said control signals based on said timing signal.

11. The controller of claim 7, further comprising:

a feedback control module, operable for generating a feedback signal based on voltages at said current sensing terminals to control a power converter coupled between said power source and said controller.

* * * * *